US006480090B1

(12) United States Patent
Wang

(10) Patent No.: US 6,480,090 B1
(45) Date of Patent: Nov. 12, 2002

(54) UNIVERSAL DEVICE FOR SAFETY SWITCHES

(75) Inventor: Ming-Shan Wang, Taipei (TW)

(73) Assignee: Tsung-Mou Yu, Taipei Hsien (TW)

( * ) Notice: Subject to any disclaimer, the term of this patent is extended or adjusted under 35 U.S.C. 154(b) by 124 days.

(21) Appl. No.: 09/715,159

(22) Filed: Nov. 20, 2000

(51) Int. Cl.[7] ..... H01H 7/16; H01H 71/58

(52) U.S. Cl. ..... 337/59; 337/59; 337/37; 337/66; 337/70

(58) Field of Search ..... 337/1, 3, 12–14, 337/16, 36, 37, 53, 59, 62, 66, 68, 70, 72, 75, 79, 85, 89, 101, 112, 113, 140; 29/622; 200/553–557

(56) References Cited

U.S. PATENT DOCUMENTS

| | | | | | |
|---|---|---|---|---|---|
| 4,363,016 | A | * | 12/1982 | Unger | 337/56 |
| 5,262,748 | A | * | 11/1993 | Tsung-Mou | 337/66 |
| 5,539,371 | A | * | 7/1996 | Yu | 337/66 |
| 5,694,106 | A | * | 12/1997 | Wang | 337/53 |
| 5,742,219 | A | * | 4/1998 | Moalem et al. | 337/37 |
| 5,760,672 | A | * | 6/1998 | Wang | 337/66 |
| 5,828,284 | A | * | 10/1998 | Huang | 337/112 |
| 5,933,069 | A | * | 8/1999 | Huang | 200/310 |
| 6,072,381 | A | * | 6/2000 | Yu | 337/112 |
| 6,121,868 | A | * | 9/2000 | Chiang | 333/112 |
| 6,335,674 | B1 | * | 1/2002 | Huang | 337/112 |

FOREIGN PATENT DOCUMENTS

CH 647094 A * 12/1984 ..... H01H/71/16

* cited by examiner

*Primary Examiner*—Anatoly Vortman
(74) *Attorney, Agent, or Firm*—Rosenberg, Klein & Lee

(57) ABSTRACT

The present invention relates to a universal device for safety switches which is used to control a conductive strip and serves as On/Off switching agent. The attachment is slopingly mounted in the switch housing. And the push-pull body used to move the conductive strip includes a pull body and an inclined spring element above the pull body. The pull body is in a free state when the conductive strip bounces upward into a deforming position. As a result, the attachment is not connected with the conductive strip; however, they are in a pull-push switching relationship such that the conductive strip is collapsible in a manner of reverse deformation for an electric disconnection in case of overload without restraint of the push-pull body of the attachment. During the ordinary state, the conductive strip maintains the usual (On/Off) switching function. Accordingly, the present invention is applicable to all kinds of safety switches for reaching a multipurpose effect of one object.

2 Claims, 13 Drawing Sheets

PRIOR. ART

UNIVERSAL DEVICE FOR SAFETY SWITCHES

BACKGROUND OF THE INVENTION

1. Field of the Invention

The present invention relates to a universal device for safety switches, and more particularly, to a main body structure applicable to all kinds of safety switches with protection circuit which is formed in a collapsible manner. In case of overload, a conductive strip bounces into a deforming shape for a complete disconnection in order to ensure the electrical safety.

2. Description of the Prior Art

A conventional wall-mounted see-saw switch, as shown in FIG. 1, is usually used to control the On/Off of a light and which generally includes a button 11 capable of being positioned in two different positions as an exerted force is applied at one end for establishing a closed or opened circuit via a retaining tab 110 which butts against a plate 12. However, this see-saw switch must be operated manually such that the closed or opened circuit can be attained once the button is pressed at one end. Unless the button is pressed at one end, otherwise the see-saw switch will remain in a preset position, i.e. opened circuit is remained in opened position; and closed circuit is remained in closed position. This see-saw switch can not be switched from the closed position to an opened position even an overload is encountered. If the supplied power can not be interrupted immediately, the electric conductive wires will become more and more hot, eventually, a risk of getting a fire can be encountered. In light of this, the safety and property of user can not be suitably protected.

U.S. Pat. No. 5,262,748, entitled to "Fuseless Breaking Switch", hereinafter referred to as '748, has disclosed a subject matter which is intended to solve the defects of the conventional see-saw switch. This fuseless breaking switch comprises a casing 10 having a button 13 pivotally mounted thereof. The bottom of the casing 10 is further provided with three sets of prongs 15, 16, 17. One set of the prongs 17 is disposed with a contact reed 170 having a platinum conductive protrusion 171 thereof. One end of the contact reed 170 is disposed above the corresponding prong 16 and is electrically connectable with the platinum conductive protrusion 160. The button 13 is further provided with a coupled piece 14, the other end of which is in turn connected to contact reed 170. When the button 13 is depressed, the prongs 16, 17 is electrically connected via the contact reed 170 and the platinum conductive protrusion 171, 160. When the current is overloaded, the contact reed 170 will be deformed by being heated. Accordingly, the electrical engagement of the contact reed 170 with said platinum conductive protrusion 31 is disconnected. Consequently, the supplied power is interrupted to ensure the safety and property of user.

Even the disclosure of U.S. Pat. No. 5,262,748 provides an improved breaking switch to solve the problem encountered by a see-saw switch, its defects can still be concluded as follows:

1. When the button 13 is depressed or jammed, or the curved spring blade 24 experiences a fatigue, the conductive protrusion 170 will not be disconnected even in case of an overload. The breaking switch itself will be melt by the increasing heat. The potential risk of getting fire can not be suitably avoided.
2. The operating principle of the breaking switch is based as follows. When the contact reed 170 made of double alloy piece is heated during an overload and the temperature rises till the breaking temperature (normally set between 100–150 degrees Celsius), the resilience will be larger than the curved spring blade 18 such that the breaking switch is actuated to opened circuit. In this case, even the button 21 is depressed to ON position and if the resilience of the contact reed 170 is still larger than the curved spring blade 18, the engagement of the conductive protrusion 171 will be disconnected as soon as it is contacted. If the button 13 is kept at depressed position, even an engagement is attained between the conductive protrusions 171, 160, the contact reed 170 doesn't work and the temperature is still increasing. On the other hand, the platinum conductive protrusions 171, 160 are contacted with each other by means of the depressing force of the user. If the force exerted thereon is not well distributed, a spark will be caused in contacting owing to load and poor contact. In this case, the platinum conductive protrusions 171, 160 will be easily oxidized and the service life will then be shortened.
3. The contact reed 170 has a planar configuration which can only be moved and deformed in one direction in experiencing an increasing heat. Accordingly, the curved spring blade 18 shall be incorporated to achieve a two-directional breaking function. The curved spring blade 18 is made from metal sheet by punching. It's difficult to make the resilient rating of each curved spring blade 18 identical. If the rating is too high, the contact reed 170 can not be disconnected during the overloaded condition and the potential risk of getting fire will happen. If the rating is too weak, the engagement between two adjacent platinum conductive protrusions is insufficient such that a spark will be caused. This caused spark will reduce the service life of the platinum conductive protrusions 171, 160.

Taiwan Pat. 334165, as shown in FIGS. 3A and 3B, discloses a change-over device of a safety switch for protecting it from overload which is intended to remove the defects of the conventional switch. The safety switch includes a change-over button 20 having an insulting drive element 21 and an attachment element 22 at one end thereof. One end of a conductive strip 23 is clamped at one side of the attachment element 22. The insulting drive element 21 is connected with a spring 24 at one end thereof. In case of overload, the conductive strip 23 will be deformed for disconnection from the contact point so that the conductive strip 23 together with the insulting drive element 21 are positioned by means of the insulting drive element 21 into an arched groove 25 for breaking the current loop. However, this kind of safety switch also includes the drawbacks of the U.S. Pat. No. 5,262,748. If one of the change-over button 20, the insulting drive element 21 or the attachment element 22 is malfunctioned, the conductive strip 23 doesn't work even in case of overload. Besides, the spring 24 is wound by a metal wire so that it's difficult that the resilience of each section thereof is identical. The drawback of too strong or too weak resilience is also existing. Thus, it's still not an excellent safety switch.

Previously, the inventor of the present invention try to remove the above-mentioned defects with U.S. Pat. No. 5,760,672. It is characterized that a slight and proper jumping space ($\Delta S$) is created between a pushing part and a pulling part of a push-pull rod 9 (similar to the above-mentioned attachment element 22). Accordingly, when a button shade or the push-pull rod 9 is malfunctioned, an alloy plate 7 (similar to the above-mentioned conductive strip 23 or the contact reed 170) will also be deformed in a half-collapsible manner to be separated from the contact point 71. Therefore, the switch is situated in a disconnected state for electrical safety. The expected effect thereof can be achieved under an ordinary state. However, the half-deformable design is still not a complete structure. Since the jumping space (ΔS) is not perfect in setting and installing aspect, the half-deformable function wouldn't work even in case of a slight carelessness.

In the above-mentioned safety switches, the attachment element (or push-pull rod) and the conductive strip (contact reed or alloy plate) are connected in a coupled state. Therefore, if one of the attachment element or the change-over button is malfunctioned, the conductive strip can't be deformed for disconnection.

In addition, all kinds of the conventional switches, such as slide switch, press switch, see-saw switch, fuseless switch, etc. their safety devices for protecting circuit inside are all different. Therefore, the manufacturer has to design each safety device for different switches. This causes difficulties for production, stock management and control of the components.

SUMMARY OF THE INVENTION

It is a primary object of the present invention to remove the above-mentioned drawbacks of the conventional safety switch and to provide a universal device applicable to all kinds of safety switches for reaching a multipurpose effect of one object.

It is another object of the present invention to provide a universal device for safety switches in which the conductive strip is deformable in the contrary direction for an electric disconnection in case of overload so that an absolute safety is attainable.

It is a further object of the present invention to provide a universal device for safety switches which is used as usual (On/Off) switch in the ordinary state.

BRIEF DESCRIPTION OF THE DRAWINGS

The accomplishment of this and other objects of the invention will become apparent from the following description and its accompanying drawings of which.

DETAILED DESCRIPTION OF THE PREFERRED EMBODIMENT

Figure 1:
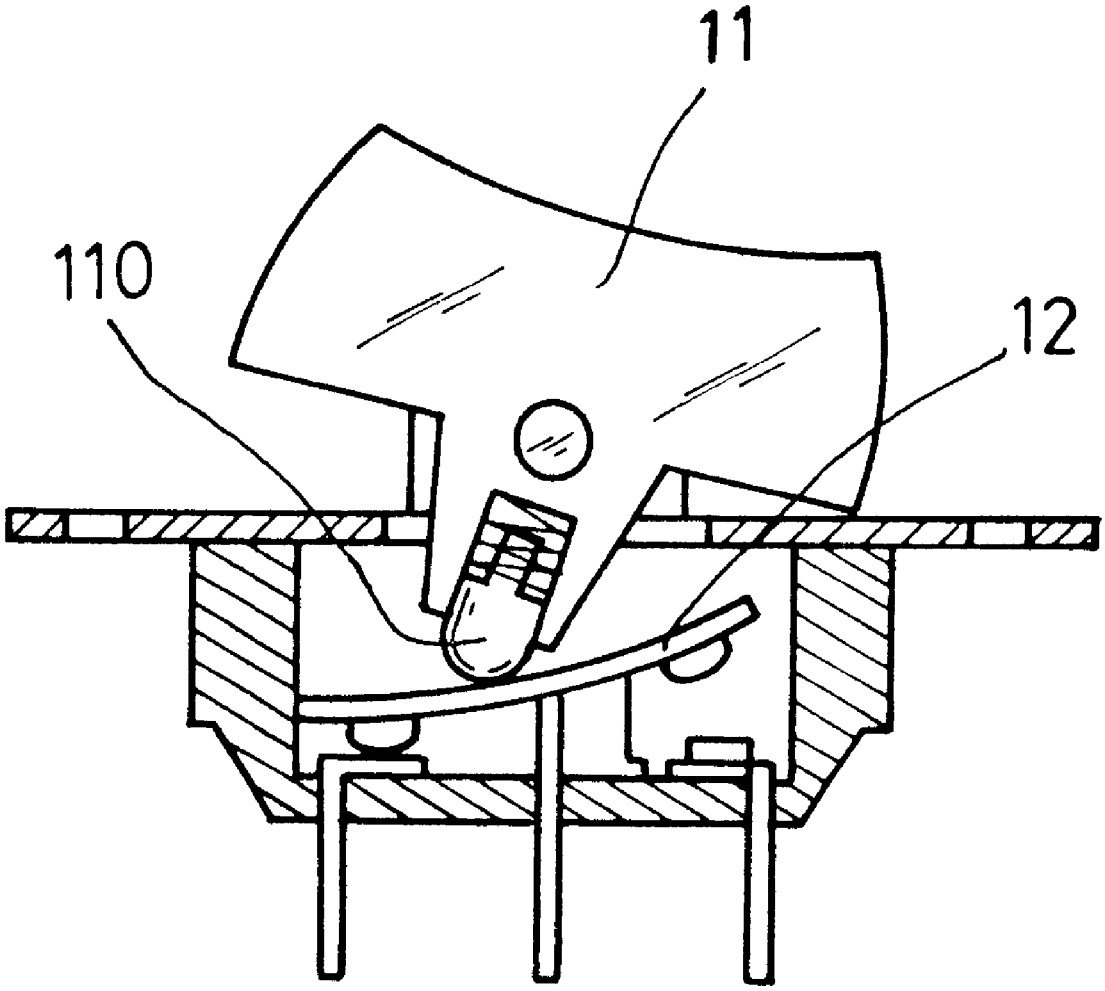
PRIOR ART FIG. 1
FIG. 1 is a schematic drawing showing the configuration of a conventional seesaw switch.
Figure 2:
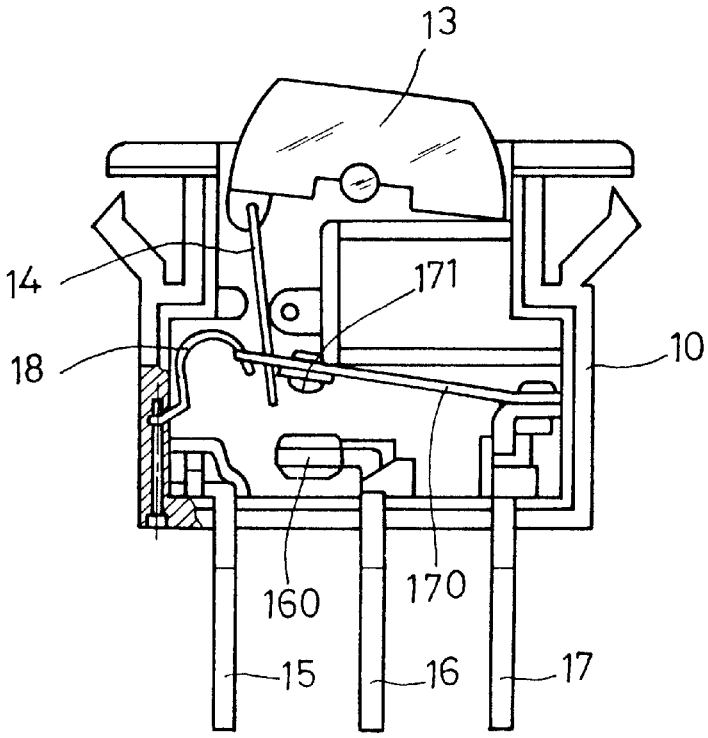
FIGS. 2A and 2B disclose the breaking switch of U.S. Pat. 5,262,748.
Figure 2:
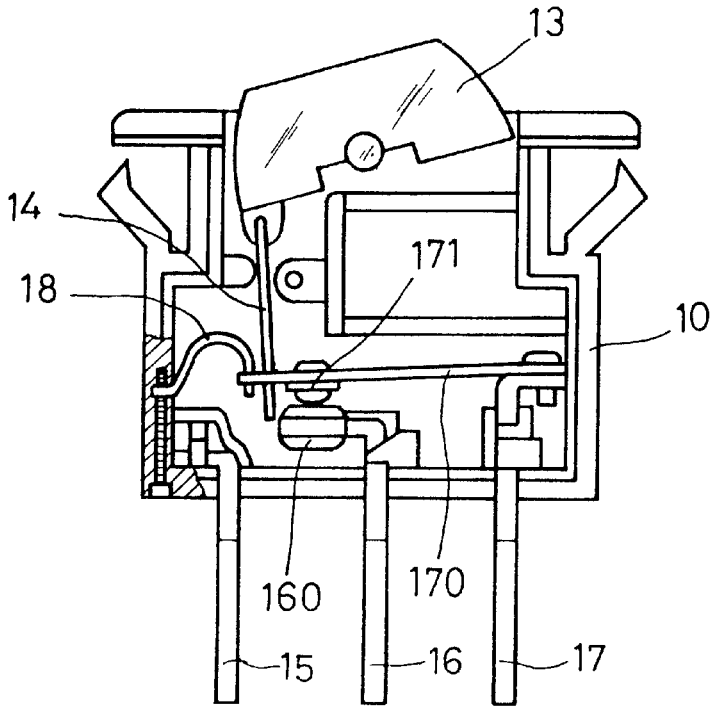
Figure 3A:
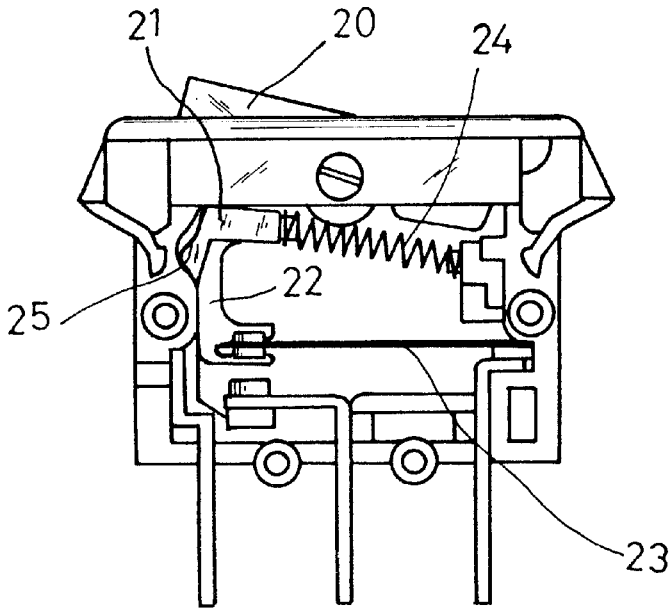
FIG. 3(A) PRIOR ART
FIGS. 3A and 3B disclose the switch of Taiwan Pat. 334156.
Figure 3B:
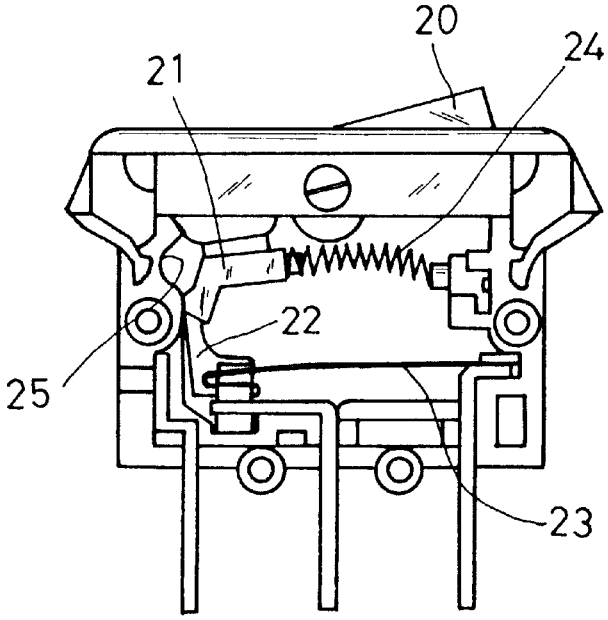
Figure 4:
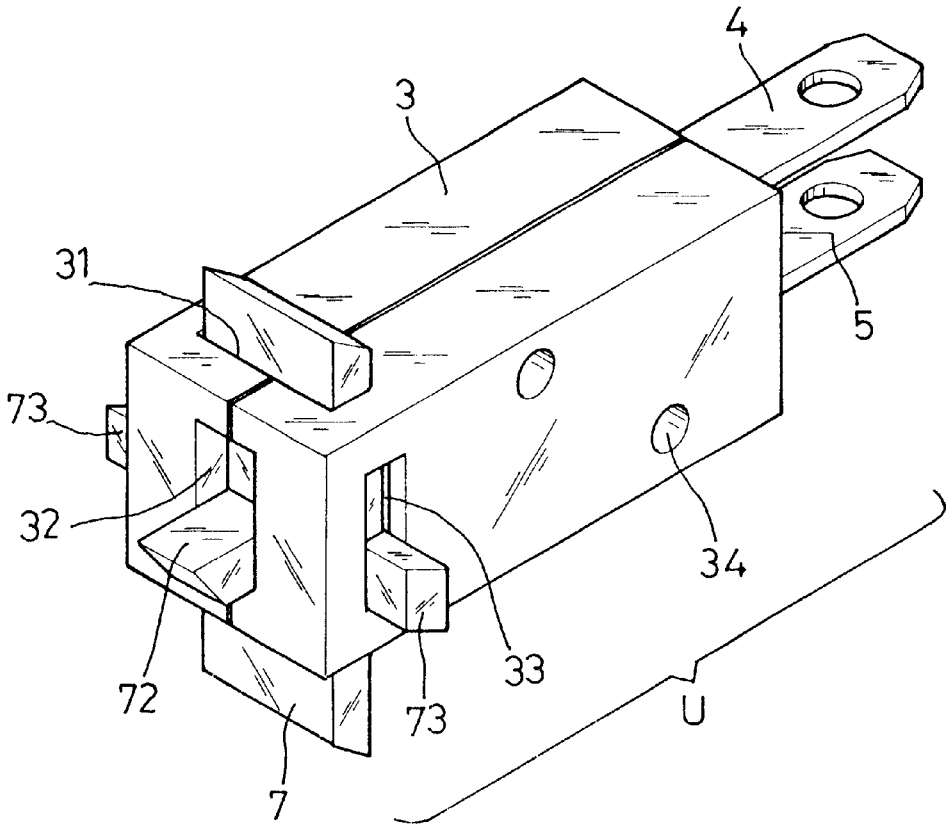
FIG. 4 is a perspective view of an applicable embodiment of the present invention.
Figure 5:
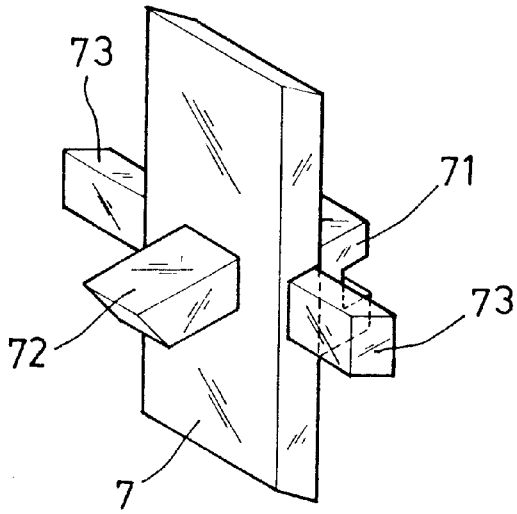
FIG. 5 is a perspective view of a from all sides movable attachment of the present invention.

First of all, referring to FIGS. 4 through 7, the universal device for safety switches in accordance with the present invention at least includes:

a switch housing 3 being a rectangular hollow case;

at least two blades 4 and 5, the first blade 4 having a platinum conductive boss 41 at bottom thereof, the top part of the second blade 5 being formed as bending portion 51 which is joined with a conductive stripe 6 being a double alloy plate and collapsible upward and downward, the conductive stripe 6 having a platinum conductive boss 61 at the top thereof and corresponding to the platinum conductive boss 41 of the first blade 4;

an attachment 7 being movable in the switch housing 3 and having a push-pull body 71 at inner side thereof for moving a projecting tongue 62 of the conductive stripe 6 into On or Off position by deforming the conductive stripe 6, the top and the bottom end of the attachment 7 extending through a groove hole 31 of the switch housing 3, a front projecting bar 72 being mounted at front side of the attachment 7 and protruding through a front opening 32 at front side of the switch housing 3, a side projecting bar 73 being mounted at two sides of the switch housing 3 and protruding through a side opening 33, the switch housing 3 having a plurality of lateral through holes 34 at two sides thereof for locating in place; and an upper and a lower projection 35, 36 being formed at the deforming position of the middle part of the conductive stripe 6 inside of the switch housing 3 and being used as auxiliary supporting point of the conductive stripe 6 in reversely deforming.

Figure 8A:
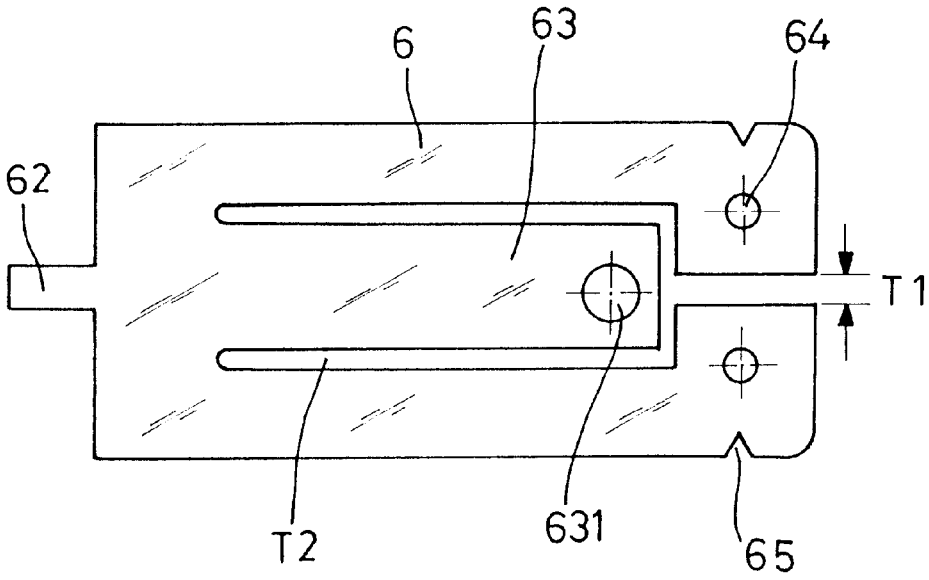
PRIOR ART FIG. 8(A)
FIG. 8(A) and 8(B) are plan views of the conductive stripe of the present invention.
Figure 8B:
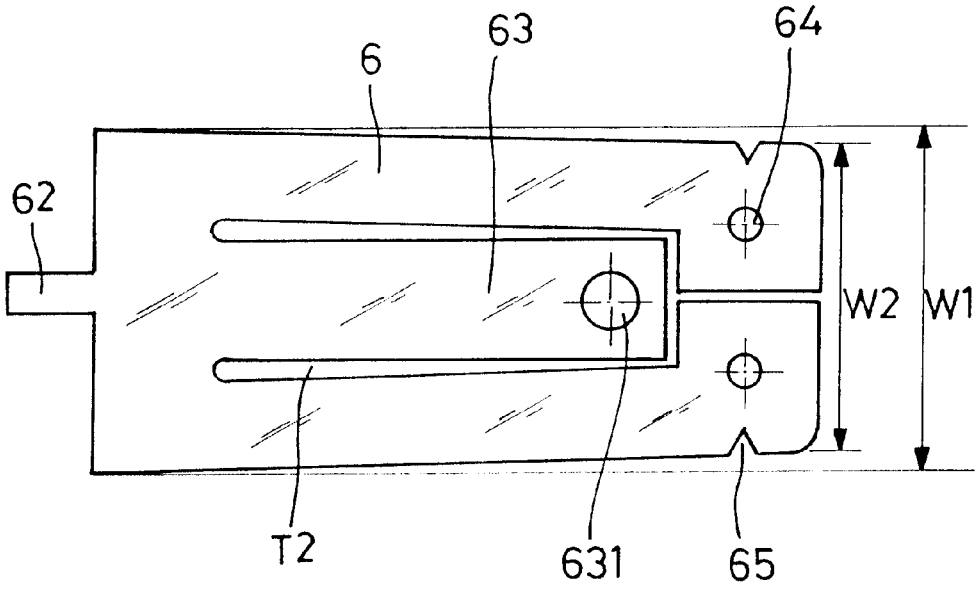
PRIOR ART FIG. 8(B)
Figure 8C:
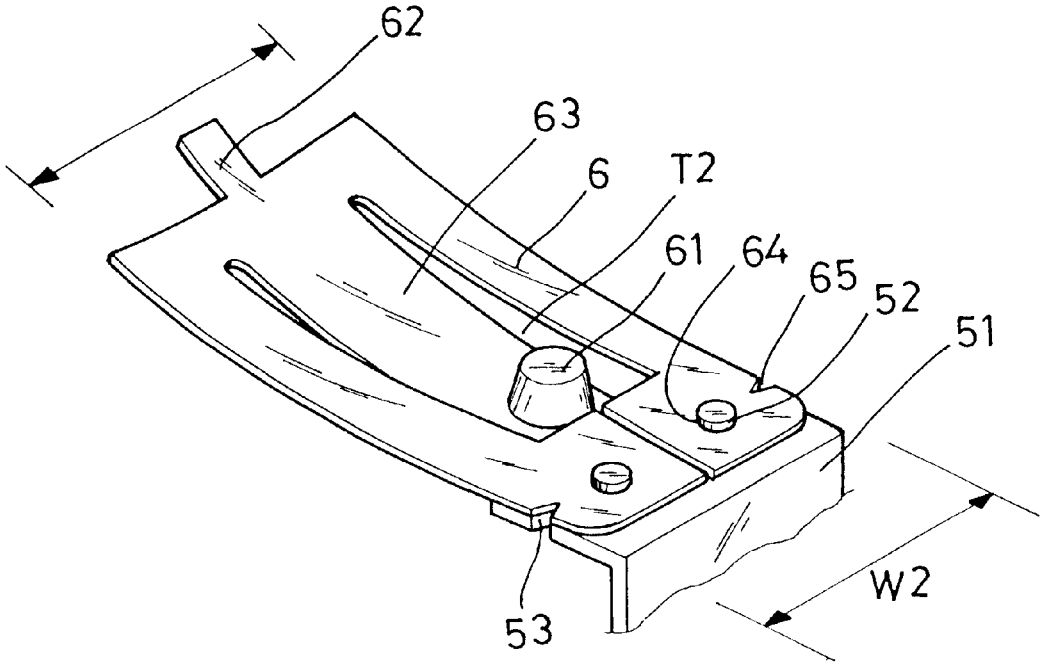
PRIOR ART FIG. 8(C)
FIG. 8(C) and 8(D) are perspective views of the conductive stripe after assembly.
Figure 8D:
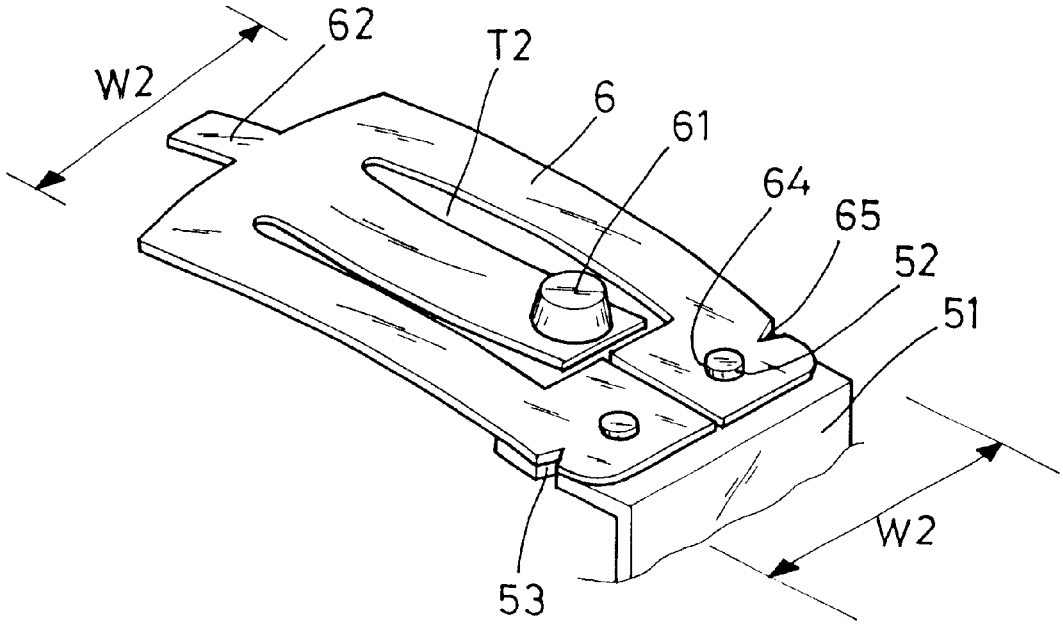
PRIOR ART FIG. 8(D)

FIG. 8(A) and 8(B) are plan views of the conductive stripe of the present invention. As shown in FIG. 8(A), the conductive strip is extended with a resilient contact piece 63 centrally from an outer end to an assembly end of thereof, and a through hole 631 is disposed at the tail of the resilient contact piece 63 for receiving the platinum conductive boss 61. The assembly end is fixed on the second blade 5. The assembly end is provided with a slit T1 centrally and which is fitted with a pair of positioning holes 64 and positioning corners at both sides along the slit T1. As shown in FIG. 8(B), the assembly end is moved close to the slit T1 such that the original width W1 is narrowed to new width W2. Accordingly, the resilient contact piece 63 has a wider the outer end while has a comparatively narrow assembly end. As shown in FIG. 8(C) and 8(D), a projection 52 of the second blade 5 is engaged in the locating hole 64 on the assembly end of the conductive stripe 6 by riveting or welding. And the locating corners 65 correspond to unfilled corners 53 of the second blade 5 in order for a clamping device to fix them on the assembly end.

The conductive stripe 6 is made from a thin metal plate and the resilient contact piece 63 disposed centrally is provided with a slit T2 in both side and tail portion thereof. When the resilient contact piece 63 is shrunk to the narrower with W2 at its assembly end, a curvature will be naturally formed by its internal stress, as shown in FIG. 8(C). On the other hand, the ratio between the width W1 of the outer end and the width W2 of the assembly end can be specially arranged such that the conductive strip 6 has bi-directional switching functions, as shown in FIG. 8(C), it can be transformed into a concave shape. When the conductive strip 6 is transformed into a concave shape, the resilient contact piece 63 is automatically extended downward according to principle of mechanical force. To the contrary, , as shown in FIG. 8(D), when the conductive strip 6 is transformed into a convex shape, the resilient contact piece 63 is extended upward such that the platinum conductive boss 61 of the conductive stripe 6 at tail portion thereof is accordingly moved upward. Consequently, the conductive stripe 6 can be deformed in both directions. The assembly way of the conductive stripe 6 doesn't belong to the feature of the present invention. The inventor has disclosed this kind of technical feature in the previous U.S. patent application. The present invention only makes use of the spring feature of the conductive stripe 6 so that it won't be described more hereinafter.

Figure 6:
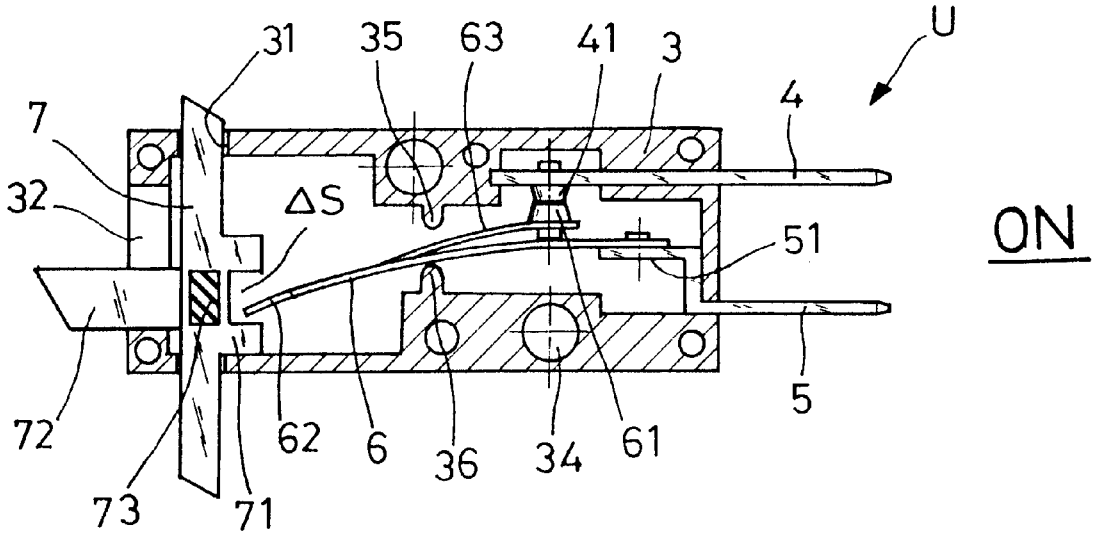
FIG. 6 is a sectional view of the applicable embodiment of the present invention showing a connected On-state.

Again, referring to FIGS. 6 and 7, when the attachment 7 is pushed downward, the push-pull body 71 brings the projecting tongue 62 of the conductive stripe 6 downward such that the resilient contact piece 63 springs upward and the platinum conductive boss 61 and the platinum conductive boss 41 of the first blade 4 contact with each other for electrical connection. Therefore, a connection (On) state of the switch (U) is available, as shown in FIG. 6. When he attachment 7 is pulled upward, the push-pull body 71 brings the projecting tongue 62 of the conductive stripe 6 upward such that the conductive stripe 6 deformed itself in reverse direction and the resilient contact piece 63 springs downward to be in disconnection (Off) state.

Figure 7:
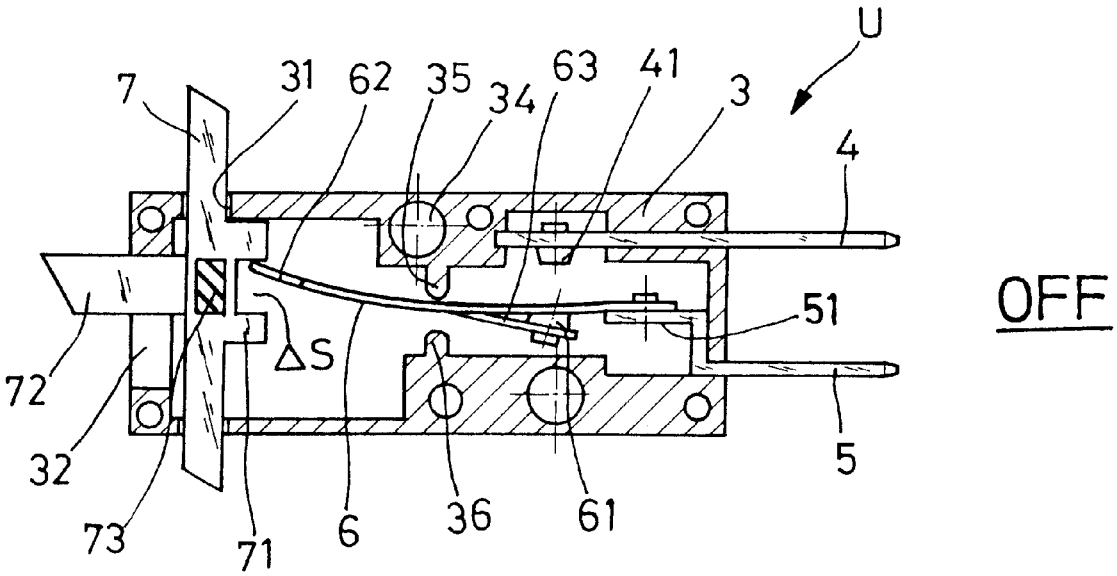
FIG. 7 is a sectional view of the applicable embodiment of the present invention showing a disconnected Off-state.
Figure 9A:
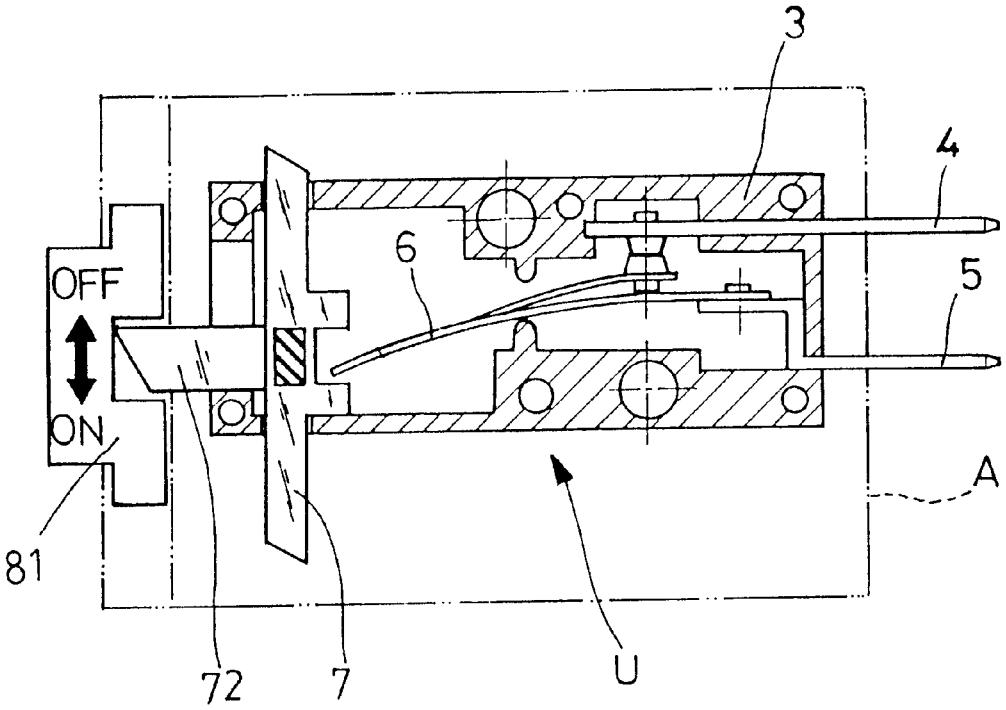
FIG. 9(A) is a schematic drawing of an embodiment of the present invention applicable to a slide switch.
Figure 9B:
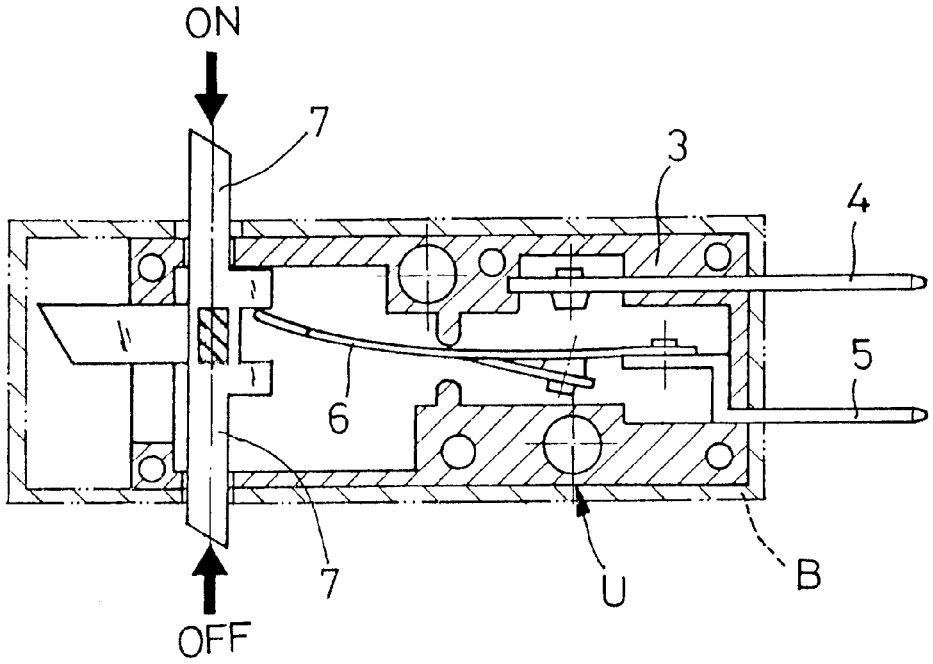
FIG. 9(B) is a schematic drawing of an embodiment of the present invention applicable to a push-pull operative switch.
Figure 9C:
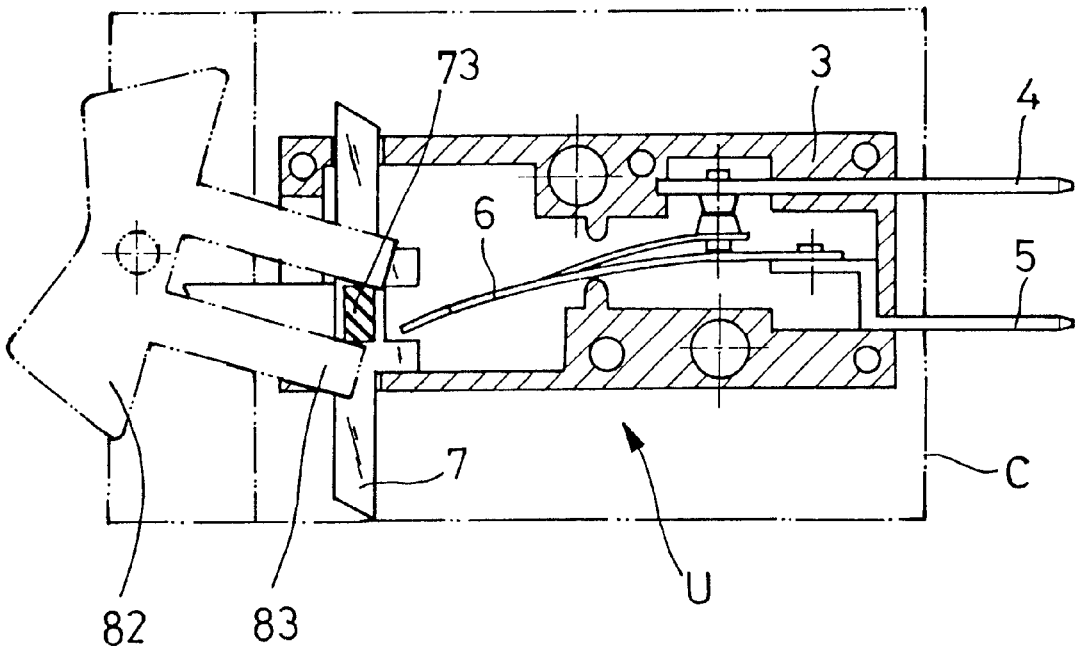
FIG. 9(C) is a schematic drawing of an embodiment of the present invention applicable to a see-saw switch.
Figure 9D:
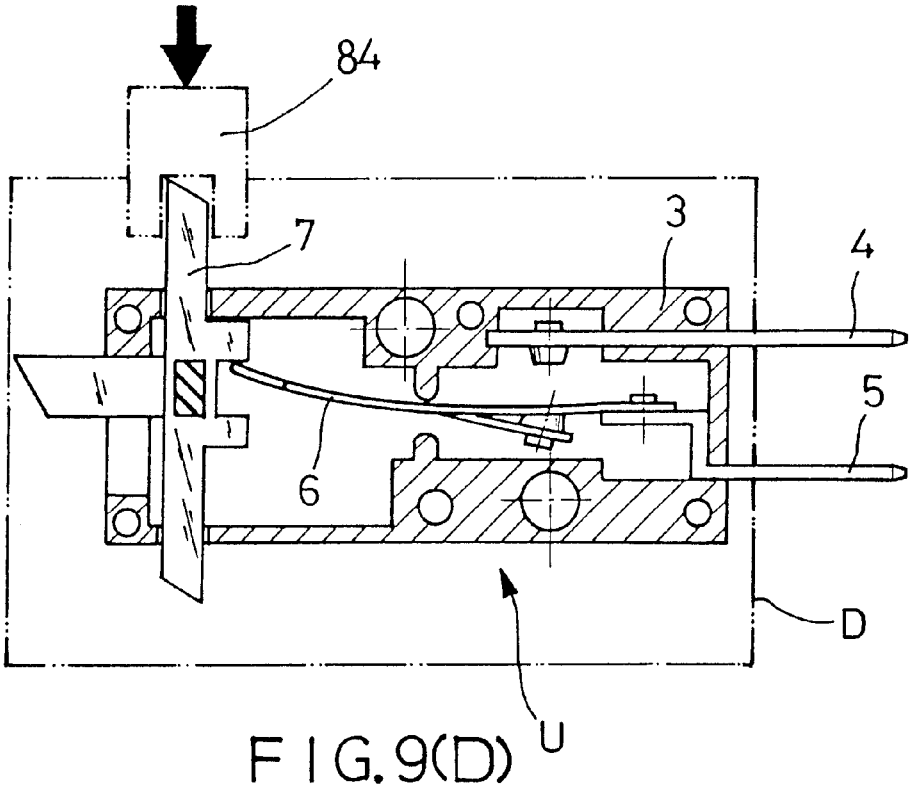
FIG. 9(D) is a schematic drawing of an embodiment of the present invention applicable to a fuseless switch.

It's apparent from FIGS. 6 and 7 that the components of the present invention is simple and practical for assembly. The On/Off switching can be achieved by means of the control of the attachment 7. In addition, the conductive stripe 6 can be brought into deformation by pulling or pushing either the front projecting bar 72 or the side projecting bar 73 of the attachment 7 upward or downward. In accordance with the above-mentioned structure, the present invention is applicable to all kinds of switches as follows:

FIG. 9(A) shows a schematic drawing of an embodiment of the present invention applicable to a slide switch (A). The front projecting bar 72 of the attachment 7 can be brought into motion by sliding a slide block 81 of the slide switch (A). Accordingly, the attachment 7 is able to control the On/Off switching of the conductive stripe 6. FIG. 9(B) shows a schematic drawing of an embodiment of the present invention applicable to a push-pull operative switch (B). The top and the bottom end of the attachment 7 protrude through the housing of the switch (B). Accordingly, the On/Off switching of the conductive stripe 6 is attainable by pushing the top and the bottom of the attachment 7. FIG. 9(C) shows a schematic drawing of an embodiment of the present invention applicable to a see-saw switch (C). The button 82 of the see-saw switch (C) has two extension legs 83 at two sides thereof for bringing the side projecting bar 73 of the attachment 7 into motion. Accordingly, the control of the conductive stripe 6 can be achieved due to the upward and downward shift of the attachment 7. FIG. 9(D) shows a schematic drawing of an embodiment of the present invention applicable to a fuseless switch (D). When the fuseless switch (D) is overloaded to enable the conductive stripe 6 to spring into disconnection (Off) state, the attachment 7 shift itself upward. Meanwhile, the attachment 7 can be shifted downward by pressing a button 84 of the fuseless switch (D) while the conductive stripe 6 is switched to a connection (On) state. This is the structure of conventional fuseless switch. Therefore, when the present invention is completed, it can be applicable to different kinds of switches. It's only required for the manufacturers to produce the housing and the peripheral components; thereafter, the present invention is installed in the preset type switch. Accordingly, a finished product is created. It's not only easy for assembly, but also lowers the production cost and reduced the control of components. The production is just practical.

As a result, it is one of the objects of the present invention to provide a universal device applicable to all kinds of safety switches for reaching a multipurpose effect of one subject. However, the present invention disclosed in FIGS. 6 and 7 can only used as On/Off switch. When the switch is overloaded, the conductive stripe 6 will spring in a reverse direction. Under the situation shown in FIGS. 6 and 7, if the attachment 7 or the slide block 81, the button 82 at the outer side are blocked or defective, the conductive stripe 6 can't be operable. Although a jumping space (ΔS) is present at the center of the push-pull body 71, the conductive stripe 6 can still spring in a half deformation, as the inventor discloses it in the U.S. Pat. No. 5,760,672. The drawbacks of the design of half deformation have been described in the background of the invention. In addition to the first object of the present invention, the conductive strip is deformable in a reverse direction for an electric disconnection (Off-state) in case of overload without restraint of the push-pull body 71 of the attachment 7. During the ordinary state, the conductive strip 6 maintains the usual (On/Off) switching function.

Figure 10:
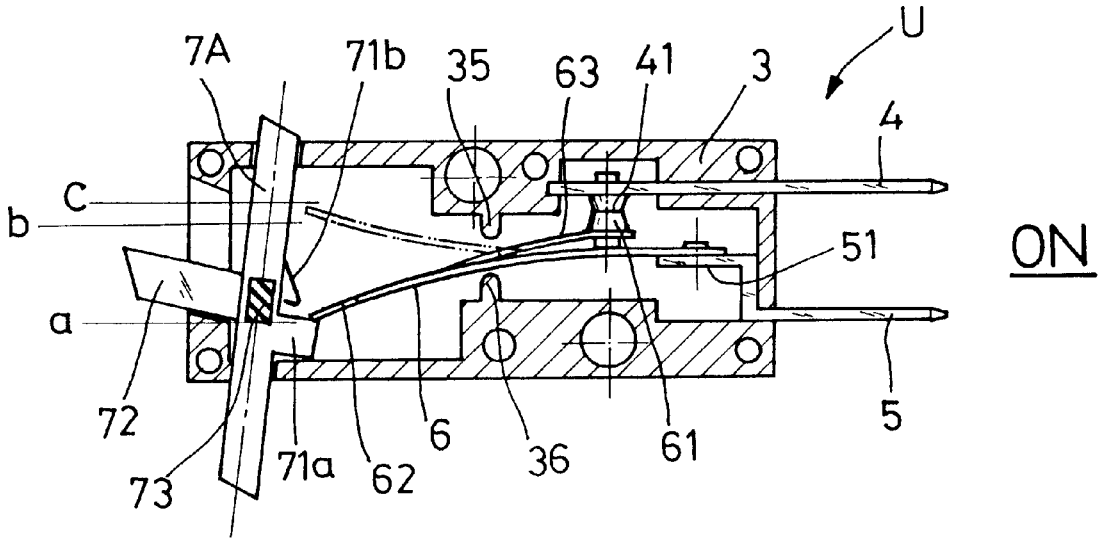
FIG. 10 is a sectional view of an applicable embodiment of the present invention showing a connected On-state.
Figure 11:
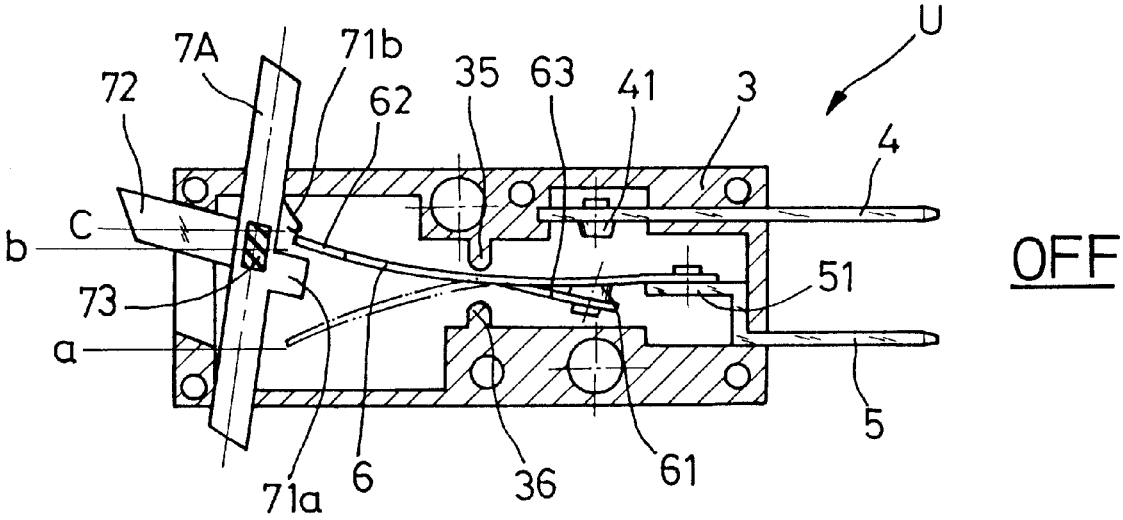
FIG. 11 is a sectional view of an applicable embodiment of the present invention showing a disconnected Off-state.
Figure 12:
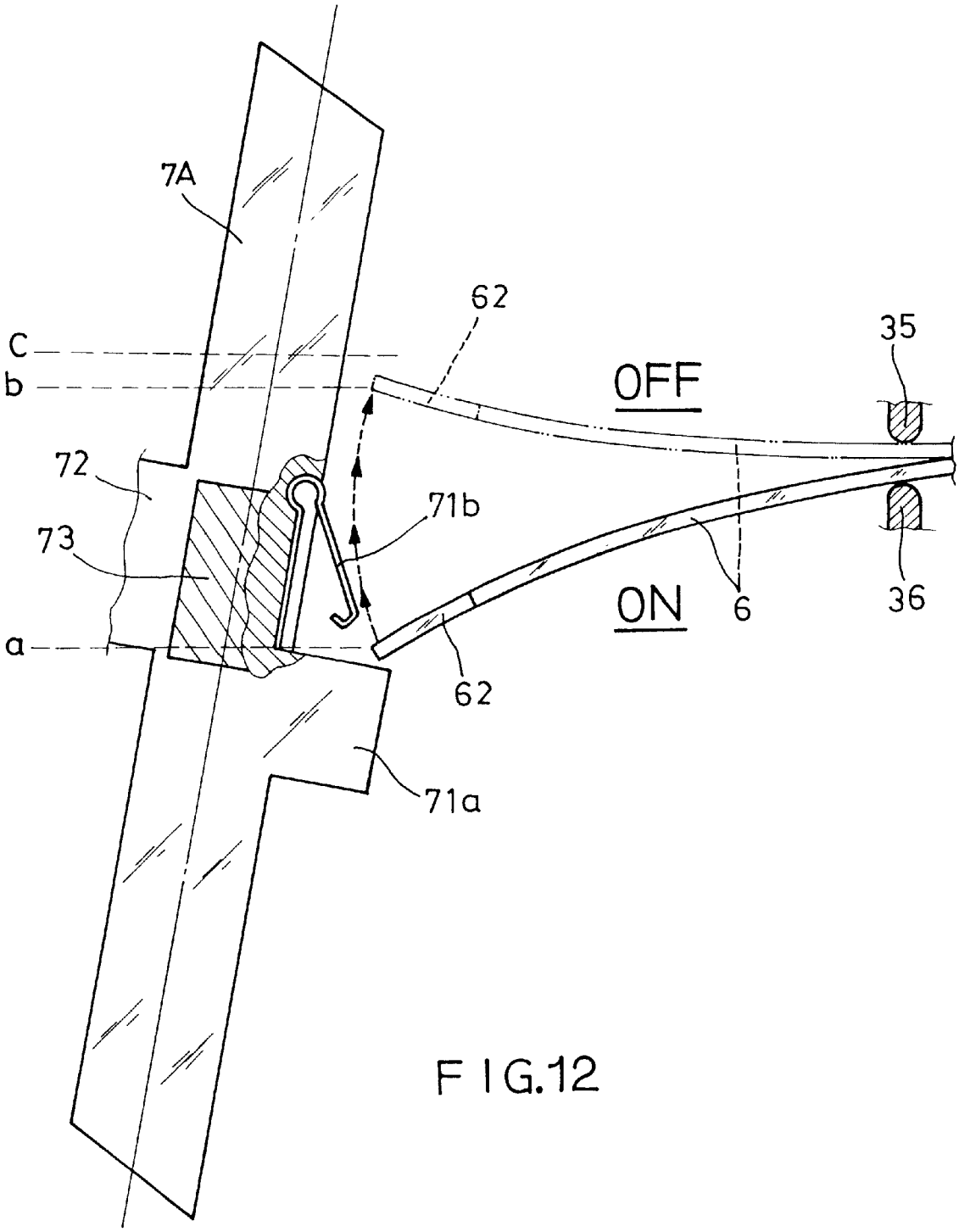
FIG. 12 is an enlarged view of partial structure of FIG. 10.

In order to reach the above-mentioned objects, the attachment 7A, as shown in FIGS. 10 and 11, is slopingly mounted in the switch housing 3, and the push-pull body used to move the conductive strip 6 includes a pull body 71*a* and an inclined spring element 71*b* above the pull body 71*a*. The pull body 71*a* is in a free state when the conductive strip 6 bounces upward to the position of the phantom line in FIG. 10. A detailed illustration is shown in FIG. 12. In the On-state, the conductive strip 6 is transformed downward such that the projecting tongue 62 is situated above the pull body 71*a*. In order to switch to Off-state, the attachment 7A shifts itself upward such hat the conductive strip 6 is moved by the pull body 71*a* for switching into an Off-state. Meanwhile, the upper supporting projection 35 serves as deforming agent for the conductive strip 6, as shown in FIG. 11. However, in case of overload, the projecting tongue 62 is not blocked by the spring element 71*b* so that the conductive strip 6 is rapidly transformed from the position (a) to the position (b) of the phantom line in FIG. 12.

Figure 13:
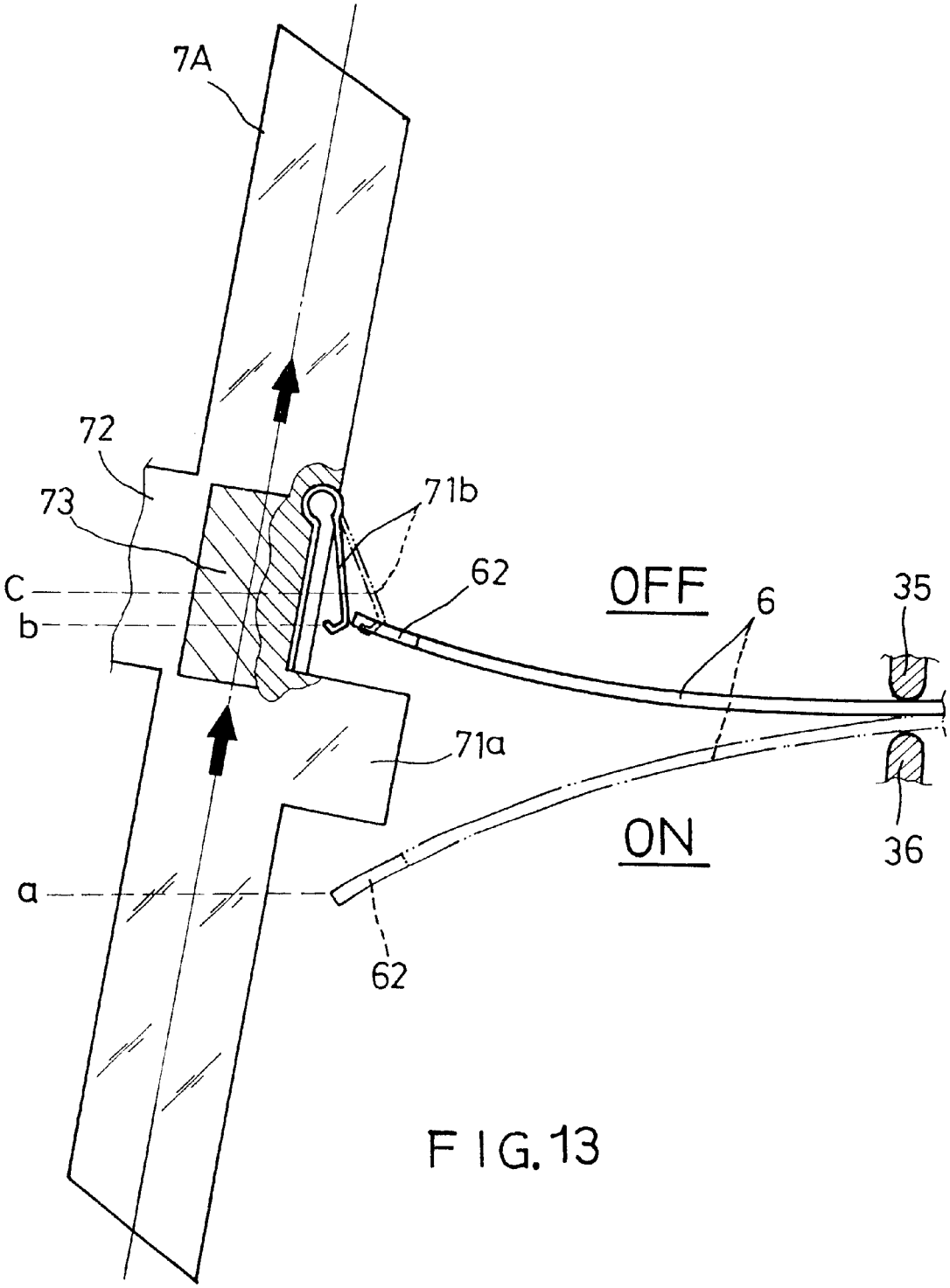
FIG. 13 is a schematic drawing of the attachment in pushing upward.
Figure 14:
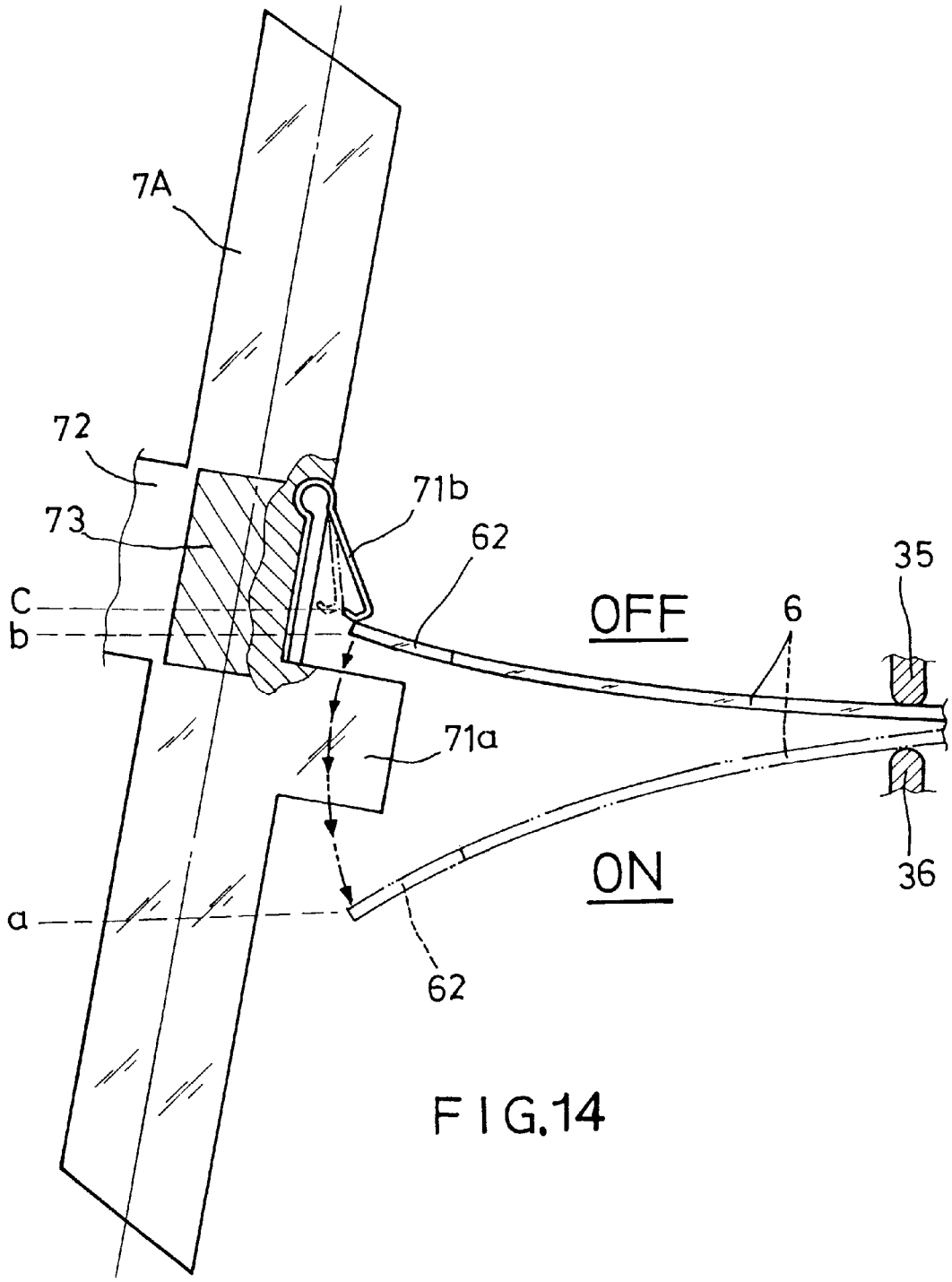
FIG. 14 is an enlarged view of partial structure of FIG. 11.

Regarding how to return the conductive strip 6 after transforming back to the On-state, please refer to FIG. 13. When the conductive strip 6 bounces from the position (a) to the position (b), the spring element 71*b* is used to push it back to the original position. Accordingly, the attachment 7A shifts itself upward, and when the spring element 71*b* is shifted upward with the curvature of the attachment 7A, it will touch the projecting tongue 62 in reaching the position (b) due to the angle difference. Thus, the spring element 71*b* shrinks itself due to its resilience and passes through the projecting tongue 62 to reach the position (c), as shown in FIG. 14. Thereafter, the spring element 71*b* resume to its original shape, and it is situated above the projecting tongue 62 by means of the angle difference formed by the curvature of the attachment 7A, as shown in FIG. 11. As a result, by depressing the attachment 7A, the conductive strip 6 is moved by the projecting tongue 62 for bouncing into a deforming state and the electric connection (On-state) is resumed.

The above-mentioned drawings are in an enlarged format so that the attachment 7A seems much inclined. In the reality, the present invention is small in volume, approx. 2 cm. Thus, when the attachment 7A is slightly inclined and the spring element 71*b* is used, the deformable effect will be achieved in case of overload. The present invention, as shown in FIG. 9(A) through 9(D), is applicable to all kinds of switches (A), (B), (C) and (D). Besides, an electric disconnection (Off-state) is rapidly attainable in case of overload to meet the requirement of the safety switch. Furthermore, the whole structure thereof is complete and perfect for reaching the assembly and production convenience and ensuring the using safety.

Many changes and modifications in the above-described embodiments of the invention can, of course, be carried out without departing from the scope thereof. Accordingly, to promote the progress in science and the useful arts, the invention is disclosed and is intended to be limited only by the scope of the appended claims.

What is claimed is:

1. A universal device for safety switches comprising:

a switch housing being a rectangular hollow case;

at least two blades, said first blade having a platinum conductive boss at bottom thereof, the top part of said second blade being formed as bending portion which is joined with a conductive stripe being a double alloy plate and collapsible upward and downward, said conductive stripe having a platinum conductive boss at the top thereof and corresponding to said platinum conductive boss of said first blade;

an attachment being movable in said switch housing and having a push-pull body at inner side thereof for moving a projecting tongue of said conductive stripe into On/Off position by deforming said conductive stripe; and an upper and a lower projection being formed at the deforming position of the middle part of said conductive stripe inside of said switch housing;

characterized in that said attachment is slopingly mounted in said switch housing, and said push-pull body used to move said conductive strip includes a pull body and an inclined spring element above said pull body, and that said pull body is in a free state when said conductive strip bounces upward into a deforming position.

2. The universal device for safety switches as claimed in claim 1, wherein the top and the bottom end of said attachment extend through a groove hole of said switch housing, and a front projecting bar is mounted at front side of said attachment and protrudes through a front opening at front side of said switch housing, and a side projecting bar is mounted at two sides of said switch housing and protrudes through a side opening, and said switch housing contains a plurality of lateral through holes at two sides thereof for locating in place.

* * * * *